US009506019B2

(12) United States Patent
Vetter et al.

(10) Patent No.: US 9,506,019 B2
(45) Date of Patent: Nov. 29, 2016

(54) SILICONE NANOEMULSION COMPRISING ALKYLENE GLYCOL ALKYL ETHER

(71) Applicant: The Procter & Gamble Company, Cincinnati, OH (US)

(72) Inventors: Nicholas David Vetter, Cleves, OH (US); Patrick Brian Whiting, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/005,078

(22) Filed: Jan. 25, 2016

(65) Prior Publication Data

US 2016/0215238 A1 Jul. 28, 2016

Related U.S. Application Data

(60) Provisional application No. 62/108,693, filed on Jan. 28, 2015.

(51) Int. Cl.

| | |
|---|---|
| ***C11D 1/825*** | (2006.01) |
| ***C11D 1/82*** | (2006.01) |
| ***C11D 7/50*** | (2006.01) |
| ***C11D 9/36*** | (2006.01) |
| ***C11D 3/37*** | (2006.01) |
| ***C11D 3/00*** | (2006.01) |
| ***C11D 17/00*** | (2006.01) |
| ***C11D 3/04*** | (2006.01) |
| ***C11D 3/20*** | (2006.01) |

(52) U.S. Cl.

CPC ..... *C11D 3/3742* (2013.01); *C11D 3/0015* (2013.01); *C11D 3/042* (2013.01); *C11D 3/2068* (2013.01); *C11D 3/2075* (2013.01); *C11D 17/0021* (2013.01)

(58) Field of Classification Search

CPC ..... C11D 3/2068; C11D 3/162; C11D 1/825; C11D 1/82; C11D 3/042; C11D 3/0094; C11D 3/3742; C11D 7/263; C11D 7/50; C11D 7/5086; C11D 9/225; C11D 9/36

See application file for complete search history.

(56) References Cited

U.S. PATENT DOCUMENTS

| | | | | |
|---|---|---|---|---|
| 4,620,878 | A | 11/1986 | Gee | |
| 4,814,376 | A | 3/1989 | Tanaka et al. | |
| 5,244,598 | A | 9/1993 | Merrifield et al. | |
| 5,712,343 | A | 1/1998 | Geck et al. | |
| 2004/0029981 | A1* | 2/2004 | Herzig | C03C 17/30 516/55 |
| 2006/0041026 | A1 | 2/2006 | Mahr et al. | |
| 2015/0030643 | A1* | 1/2015 | Gartstein | A61K 8/345 424/401 |
| 2015/0030644 | A1 | 1/2015 | Oh | |

OTHER PUBLICATIONS

Dow Chemical Company: "Product Information DOW P-Series Glycol Ethers" • 1• Jul. 2002 (Jul. 1, 2002). XP055261542. Retrieved from the Internet: URL:http://msdssearch.dow.com/PublishedLiteratureDOWCOM/dh 012d/0901b8038012d976.pdf URL:http://msdssearch.dow.com/PublishedLiteratureDOWCOM/dh 012d/0901b8038012d976.pdf?filepath~oxysolvents/pdfs/noreg/110-00977.pdf&fromPage~GetDoc [retrieved on May 18, 2016] the whole document.

PCT Search Report for International Application No. PCT/US2016/014678, dated Apr. 11, 2016, 13 pages.

* cited by examiner

*Primary Examiner* — Charles Boyer

(74) *Attorney, Agent, or Firm* — Gregory S. Darley-Emerson; Leonard W. Lewis; Steven W. Miller

(57) ABSTRACT

Silicone nanoemulsions that include alkylene glycol alkyl ethers. Treatment compositions that include such silicone nanoemulsions. Methods of making such nanoemulsions and treatment compositions.

24 Claims, No Drawings

SILICONE NANOEMULSION COMPRISING ALKYLENE GLYCOL ALKYL ETHER

FIELD OF THE INVENTION

The present disclosure relates to silicone nanoemulsions. More specifically, the present disclosure relates to silicone nanoemulsions that include alkylene glycol alkyl ether. The present disclosure further relates to treatment compositions that include such silicone nanoemulsions, as well as methods of making such nanoemulsions and treatment compositions.

BACKGROUND OF THE INVENTION

Silicone emulsions are known and may be useful in certain treatment compositions, such as fabric care compositions. The silicone may provide softness and/or color restoration benefits. In certain treatment compositions, silicone nanoemulsions may be particularly useful. Such nanoemulsions may have average particle sizes of from 10 nm to 1000 nm.

However, such small particle sizes can be challenging to obtain. High energy mixers and process are typically used may be used to make the nanoemulsions, but the equipment and/or energy involved is typically quite substantial and costly. Further, making emulsions with high energy mixing can result in emulsions that are unstable, for example due to aeration of the emulsion. Without wishing to be bound by theory, it is believed that air trapped in the emulsion may be released upon storage, bringing silicone droplets to the air/water interface, leading to phase separation.

Thus, there is a need for stable silicone nanoemulsions that can be obtained efficiently, economically, and that provide the desired benefits.

SUMMARY OF THE INVENTION

The present disclosure relates to silicone nanoemulsions. More specifically, the present disclosure relates to amino silicone nanoemulsions that include one or more liquid silicone compounds, an internal phase diluent that includes a C3-C6 alkylene glycol alkyl ether, a surfactant system, and a protonating agent.

The present disclosure also relates to a method of making an amino silicone nanoemulsion that includes the steps of mixing the amino silicone with the internal phase diluent to form a first composition; adding the surfactant system, the protonating agent, and water to the first composition; and mixing, for example, mixing using an energy density less than about 4 $kW/m^3$.

The present disclosure also relates to treatment compositions that include the nanoemulsions described herein.

The present disclosure also relates to methods of making treatment compositions that include the steps of providing a base composition and mixing in the amino silicone nanoemulsion.

DETAILED DESCRIPTION OF THE INVENTION

The present disclosure relates to silicone nanoemulsions that include an aminosilicone fluid, a surfactant system, an internal phase diluent, and a protonating agent. In particular, C3-C6 alkylene glycol alkyl ethers have been found to be effective internal phase diluents in such emulsions.

It has been surprisingly found that careful selection of a solvent to be used as an internal phase diluent can provide an effective silicone nanoemulsion that is relatively easy to make. Without intending to be bound by theory, it is believed that such selection requires the balancing of several factors. The internal phase diluent should be miscible with the silicone polymer to be emulsified; however, it should not lower the surface tension of the silicone fluid so much that emulsification is impossible. Additionally, it is believed that only certain solvents work with the surfactant system of the emulsion to help further increase the surfactant packing efficiency, thereby resulting in smaller emulsion droplet sizes.

As used herein, the articles including "the," "a" and "an" when used in a claim or in the specification, are understood to mean one or more of what is claimed or described.

As used herein, the terms "include," "includes" and "including" are meant to be non-limiting.

As used herein, the terms "substantially free of" or "substantially free from" means that the indicated material is at the very minimum not deliberately added to the composition to form part of it, or, preferably, is not present at analytically detectable levels. It is meant to include compositions whereby the indicated material is present only as an impurity in one of the other materials deliberately included. A composition that is "substantially free of" or "substantially free from" a material may include less than about 0.1%, or less than about 0.01%, of the material, by weight of the composition.

As used herein, the term "HLB value" refers to the hydrophile-lipophile balance (HLB) scale devised by Griffin in 1949, which is a scale from 0-20 (20 being Hydrophilic) used to characterize the nature of molecules, such as surfactants. The HLB of a molecule is calculated as follows:

$$HLB=20*Mh/M$$

where Mh is the molecular mass of the hydrophilic portion of the molecule, and M is the molecular mass of the whole molecule, giving a result on a scale of 0 to 20. An HLB value of 0 corresponds to a completely lipophilic/hydrophobic molecule, and a value of 20 corresponds to a completely hydrophilic/lipophobic molecule. See Griffin, W. C. Calculation of HLB values of Nonionic Surfactants, J. Soc. Cosmet. Chem. 1954, 5, 249-256. The HLB values for commonly-used surfactants are readily available in the literature (e.g., HLB Index in McCutcheon's Emulsifiers and Detergents, MC Publishing Co., 2004). The HLB value for a mixture of surfactants can be calculated as a weighted average of the HLB values of the surfactants.

As used herein, the term "nanoemulsion" refers to thermal dynamically stable oil in water emulsions that have extremely small droplet sizes (e.g., below 1000 nm, or below 750 nm, or below 500 nm, or below 350 nm, or below 250 nm). These materials have special properties, including optical translucency, very large dispersed phase surface-to-volume ratios and long term kinetic stability. Due to similarity in appearance, translucent nanoemulsions are sometimes confused with microemulsions, which belong to another class of stable (thermodynamically) and optically clear colloidal systems. Microemulsions are spontaneously formed by "solubilizing" oil molecules with a mixture of surfactants, co-surfactants and co-solvents. The required surfactant concentration in a microemulsion is several times higher than that in a nanoemulsion and significantly exceeds the concentration of the dispersed phase (generally, oil). Because of many undesirable side-effects caused by surfactants, this is disadvantageous or prohibitive for many applications. In addition, the stability of microemulsions is easily compromised by dilution, heating, or changing pH levels.

All cited patents and other documents are, in relevant part, incorporated by reference as if fully restated herein. The citation of any patent or other document is not an admission that the cited patent or other document is prior art with respect to the present invention.

In this description, all concentrations and ratios are on a weight basis of the cleaning composition unless otherwise specified.

Nanoemulsion

The compositions of the present disclosure include amino silicone nanoemulsions. The nanoemulsions may have an internal phase, which may include particles, suspending in a bulk phase. The internal phase may include the amino silicone. The internal phase may further include the surfactant, which may act as an emulsifying agent, the protonating agent, and/or the internal phase diluent. The bulk phase may be primarily (e.g., at least 50%) water, but the bulk phase may also include amounts of amino silicone, surfactant, and/or internal phase diluent. However, the majority of these ingredients may be found in the internal phase.

The nanoemulsion may include particles suspended in the bulk phase. The average particle size of the nanoemulsion may be from about 20 nm to about 500 nm, or from about 30 nm to about 400 nm, or from about 40 nm to about 250 nm, or from about 50 nm to about 150 nm, or from about 60 to about 100, or from about 70 nm to about 80 nm. Average particle size is determined according to the method disclosed herein.

The nanoemulsions of the present disclosure may be optically translucent. The nanoemulsions are characterized by a Percentage Transmittance (% T) of at least about 80%, or at least about 85%, or at least about 90%, or at least about 95% at 480 nm, where % T is measured according to the Percentage Transmittance method disclosed herein.

The nanoemulsions of the present disclosure may be stable. As used herein, "stable" means maintaining at least 75% of original average particle size distribution after storage at room temperature (22° C.) for at least thirty days.

The nanoemulsions of the present disclosure may include an amino silicone, an internal phase diluent, a surfactant system, and a protonating agent. The ratio of amino silicone to internal phase diluent may be from 1:1 to about 10:1, or from about 2:1 to about 8:1, or from about 3:1 to about 5:1, or about 4:1. The ratio of surfactant to silicone may be from about 1:1 to about 50:1, or from about 2:1 to about 25:1, or from about 5:1 to about 15:1, or from about 8:1 to about 12:1, or about 10:1.

The nanoemulsions of the present disclosure may be intended to be components of other, finished treatment compositions. Thus, the present nanoemulsions may have a limited number of ingredients, which may provide processing, cost, and/or formulation flexibility benefits. The nanoemulsions may have no more than about eight, or no more than about seven, or no more than about six, or no more than about five ingredients. As used herein, a surfactant system may count as a single ingredient.

Amino Silicone Compound

The amino silicone nanoemulsions of the present disclosure include one or more amino silicone compounds. One species of amino silicone compound may be used alone or two or more species may be used together. The amino silicone compound may be a liquid. The viscosity of the liquid amino silicone compound may be from about 10 mPa·s, or from about 50 mPa·s, or from about 100 mPa·s, or from about 200 mPa·s, to about 100,000 mPa·s, or to about 10,000 mPa·s, or to about 1000 mPa·s, or to about 500 mPa·s, at 25° C. The amino silicone compound may have a viscosity of from about 200 mPa·s to about 500 mPa·s, at 25° C.

The nanoemulsion may comprise from about 15% to about 60%, or from about 17% to about 50%, or from about 20% to about 45%, or from about 25% to about 40%, or from about 30% to about 35%, by weight of the nanoemulsion, of the amino silicone compound.

The amino silicone compound may be represented by structural formula (1) below:

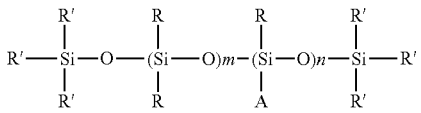

(1)

where each R group is independently selected from substituted or unsubstituted alkyl or aryl groups having from about 1 to about 22 carbon atoms, each R' group is independently selected from substituted or unsubstituted alkyl or aryl groups having from about 1 to about 22 carbon atoms, or monovalent groups represented by the formula: $—OR^3$, where $R^3$ is a hydrogen atom or a monovalent hydrocarbon group with 1-10 carbon atoms; m is a whole number from about 20 to about 1000, or from about 50 to about 800; n is a whole number from about 1 to about 100, or from about 5 to about 80.

A may be a monovalent group represented by formula (2) below:

$$—R^1—(NH—R^2)_a—NH_2 \quad (2)$$

where each of $R^1$ and $R^2$ is independently selected from divalent hydrocarbon groups having 1-22 carbon atoms, more typically 1-8 carbon atoms, even more typically 1-4 carbon atoms. Suitable $R^1$ and $R^2$ groups include methylene groups, ethylene groups, trimethylene groups, tetramethylene groups, or other alkylene groups. In some aspects, each of $R^1$ and $R^2$ is a methylene group; a is a whole number from about 0 to about 4, or a is a whole number from about 0 to about 2, or a is 0 or 1.

Examples of suitable A groups include $—CH_2—NH_2$, $—(CH_2)_2—NH_2$, $—(CH_2)_3—NH_2$, $—(CH_2)_2—NH—(CH_2)_3NH_2$, $—(CH_2)_3—NH—(CH_2)_2NH_2$, $—(CH_2)_3—HN—(CH_2)_3NH_2$, and $—(CH_2)_3—NH—(CH_2)_3—NH—(CH_2)_3—NH_2$.

In the amino silicone compound of formula (1), the ratio of m/n may be less than about 500, or less than about 250, or less than about 175, or less than about 125, or less than about 100, or less than about 75.

The amino silicone compound may be represented by general formula (1), where each R is a methyl group, each R' is a methyl group, A is an amino propyl group or an amino propyl amino ethyl group, and m/n is about 200.

In some aspects, in the amino silicone compound represented by general formula (1), from about 1% to about 20% of the terminal R' groups are monovalent groups represented by the formula: $—OR^3$, where $R^3$ is a hydrogen atom or a monovalent hydrocarbon group with 1-10 carbon atom.

Commercially available amino silicone compounds suitable for the nanoemulsions and treatment compositions of the present disclosure may include Magnasoft® Plus (available from Momentive, Waterford, N.Y.), KF-869 (available from Shin-Etsu, Akron, Ohio), DC 2-8040 (available from Dow Corning, Midland, Mich.).

The liquid amino silicone compound may be characterized by a hydrophilic-lipophilic balance (HLB) value ranging from about 8 to about 15, or from about 10 to about 13.5.

Silicone Resin

Typically, the amino silicone nanoemulsion of the present disclosure is substantially free of a silicone resin.

An example of a silicone resin is a mixture of polyorganosiloxane-silicone resins, where each of the one or more silicone resins of the polyorganosiloxane-silicone resin mixture contains at least about 80 mol % of units selected from the group consisting of units of the general formulas 3, 4, 5, 6:

$$R^4{}_3SiO_{1/2} \quad (3),$$

$$R^4{}_2SiO_{2/2} \quad (4),$$

$$R^4SiO_{3/2} \quad (5),$$

$$SiO_{4/2} \quad (6),$$

in which $R^4$ is selected from H, —OR, or —OH residues or monovalent hydrocarbon residues with 1 to 40 carbon atoms, optionally substituted with halogens, where at least 20 mol % of the units are selected from the group consisting of units of the general formulas 5 and 6, and a maximum of 10 wt % of the $R^4$ residues are —OR and —OH residues.

Internal Phase Diluent

The amino silicone nanoemulsions of the present disclosure may include an internal phase diluent. The internal phase diluent should be miscible with the fluid amino silicone compound and compatible with the surfactant system. Without intending to be bound by theory, the internal phase diluent aids in diluting the viscosity of the fluid amino silicone compound. The dilution and consequent viscosity decrease facilitate ease of processing the nanoemulsions, for example, incorporating the nanoemulsions into treatment compositions, because nanoemulsions with lower viscosities require less energy and/or pressure to be pumped or transported during processing. Additionally, careful selection of the internal phase diluent may enable the average particle size of the nanoemulsion to be relatively small with a minimum of processing. Preferred internal phase diluents are characterized by surfactant-like properties (such as having hydrophilic portions and hydrophobic portions) and low to moderate polarities. The internal phase diluent may also be referred to a solvent.

The internal phase diluent may have a hydrophilic-lipophilic balance (HLB) ranging from about 6 to about 14, or from about 8 to about 12, or about 11. One type of internal phase diluent may be used alone, or two or more types of internal phase diluents may be used together.

The internal phase diluent may be miscible with the liquid amino silicone compound. The internal phase diluent may be from about 10%, or from about 25%, or from about 40%, or from about 70%, or from about 90%, to about 100% miscible with the liquid amino silicone compound, as determined by the Miscibility Method disclosed herein.

The internal phase diluent may include, may consist essentially of, or may consist of a C3-C6 alkylene glycol alkyl ether. It has been found that C3-C6 alkylene glycol alkyl ethers provide benefits in the nanoemulsions of the present disclosure and facilitate, for example, small average particle sizes and/or low energy processing. Without intending to be bound by theory, it is believed that the C3-C6 alkylene glycol alkyl ethers have a lower polarity and lower water solubility, compared to ethylene glycol alkyl ethers.

The C3-C6 alkylene glycol alkyl ether may include a propylene glycol alkyl ether. The propylene glycol alkyl ether may be selected from the group consisting of a monopropylene glycol alkyl ether, a dipropylene glycol alkyl ether, a tripropylene glycol alkyl ether, and mixtures thereof. The propylene glycol alkyl ether may be a monopropylene glycol alkyl ether.

The C3-C6 alkylene glycol alkyl ether may include C3-C6 alkylene glycol C1-C12 alkyl ether, or C3-C6 alkylene glycol C1-C8 alkyl ether, or C3-C6 alkylene glycol C1-C4 alkyl ether. By way of example, the "C1-C12 alkyl" group of a C3-C6 alkylene glycol C1-C12 alkyl ether is an alkyl group having from one to twelve carbons. Suitable alkyl groups include butyl groups, hexyl groups, phenyl groups, heptyl groups, octyl groups, 2-ethylhexyl groups, nonyl groups, decyl groups, undecyl groups, and dodecyl groups. The alkyl group may be linear, branched, or cyclic.

The C3-C6 alkylene glycol alkyl ether may include C3-C6 alkylene glycol C1-C4 alkyl ether. The C3-C6 alkylene glycol alkyl ether may be selected from C3-C6 alkylene glycol methyl ether, C3-C6 alkylene glycol ethyl ether, C3-C6 alkylene glycol n-propyl ether, C3-C6 alkylene glycol n-butyl ether, and mixtures thereof. The C3-C6 alkylene glycol ether may be selected from propylene glycol methyl ether, propylene glycol ethyl ether, propylene glycol n-propyl ether, propylene glycol n-butyl ether, and mixtures thereof.

The C3-C6 alkylene glycol alkyl ether may include propylene glycol n-butyl ether, which is believed, for example, to facilitate small average particle sizes. The propylene glycol alkyl ether may be selected from the group consisting of a monopropylene glycol n-butyl ether, a dipropylene glycol n-butyl ether, a tripropylene glycol n-butyl ether, and mixtures thereof. The propylene glycol alkyl ether may be a monopropylene glycol n-butyl ether.

The nanoemulsion may include from about 10% to about 50%, or from about 15% to about 40%, or from about 20% to about 35%, or more than 20% to about 35%, or from about 25% to about 30%, by weight of the amino silicone compound, of the internal phase diluent.

The internal phase diluent may be characterized by its solubility and/or its polarity, such as by the Hansen Solubility Parameter (HSP). For example, the internal phase diluent may be characterized by an HSP p (polarity) value of from about 1 to about 7.5, or from about 1.5 to about 5, or from about 2.5 to about 5.

Surfactant

The amino silicone nanoemulsion of the present disclosure may include from about 1% to about 40% of one or more surfactants, by weight of the amino silicone. The combined weight of the surfactant plus the internal phase diluent may be less than about 50%, or less than about 45%, or less than about 40%, or less than about 35%, or less than about 32%, by weight of the amino silicone. The amino silicone nanoemulsion may include from about 1% to about 30%, or from about 1% to about 25%, or from about 1% to about 20% of one or more surfactants, by weight of the amino silicone. The amino silicone nanoemulsion may include from about 5% to about 20% or from about 10% to about 20% of one or more surfactants, by weight of the amino silicone.

The surfactant may be selected from nonionic surfactant, anionic surfactant, cationic surfactant, zwitterionic surfactant, ampholytic surfactant, amphoteric surfactant, and mixtures thereof. The amino silicone nanoemulsion of the present disclosure may include a nonionic surfactant, a cationic surfactant, or a mixture thereof. The amino silicone nanoemulsion of the present disclosure may include, or may consist of, nonionic surfactant. The nonionic surfactant may include at least a first nonionic surfactant and a second nonionic surfactant. It is believed that surfactant, particularly nonionic surfactant, facilitates uniform dispersal of the amino silicone fluid compound and the internal phase diluent in water.

Nonionic Surfactants

Suitable nonionic surfactants useful herein may comprise any conventional nonionic surfactant. More specific examples of suitable nonionic surfactants include, for example, polyoxyethylene alkyl ethers, polyoxyethylene polyoxypropylene alkyl ethers or other polyoxyalkylene alkyl ethers; polyoxyethylene alkylphenyl ethers; polyoxyethylene alkyl esters; polyoxyethylene alkyl phenyl ether sorbitan esters; glycerin esters; sorbitan fatty acid esters; sucrose fatty acid esters or other polyhydric alcohol fatty acid esters; ethoxylated fatty acids; and ethoxylated fatty acid amides. The nonionic surfactant may be selected from polyoxyethylene alkyl ethers, polyoxyethylene polyoxypropylene alkyl ethers, or a mixture thereof.

Other non-limiting examples of nonionic surfactants useful herein include alkoxylated fatty alcohols, e.g., ethoxylated nonionic surfactant, and amine oxide surfactants. These materials are described in U.S. Pat. No. 4,285,841, Barrat et al, issued Aug. 25, 1981. The nonionic surfactant may be selected from the ethoxylated alcohols and ethoxylated alkyl phenols of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15. These surfactants are more fully described in U.S. Pat. No. 4,284,532, Leikhim et al, issued Aug. 18, 1981. Further non-limiting examples of nonionic surfactants useful herein include: $C_{12}$-$C_{18}$ alkyl ethoxylates, such as, NEODOL® nonionic surfactants from Shell; $C_6$-$C_{12}$ alkyl phenol alkoxylates wherein the alkoxylate units are a mixture of ethyleneoxy and propyleneoxy units; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA, as discussed in U.S. Pat. No. 6,150,322; $C_{14}$-$C_{22}$ mid-chain branched alkyl alkoxylates, $BAE_x$, wherein x is from 1 to 30, as discussed in U.S. Pat. No. 6,153,577, U.S. Pat. No. 6,020,303 and U.S. Pat. No. 6,093,856; Alkylpolysaccharides as discussed in U.S. Pat. No. 4,565,647 to Llenado, issued Jan. 26, 1986; specifically alkylpolyglycosides as discussed in U.S. Pat. No. 4,483,780 and U.S. Pat. No. 4,483,779; Polyhydroxy fatty acid amides as discussed in U.S. Pat. No. 5,332,528, WO 92/06162, WO 93/19146, WO 93/19038, and WO 94/09099; and ether capped poly(oxyalkylated) alcohol surfactants as discussed in U.S. Pat. No. 6,482,994 and WO 01/42408.

The nonionic surfactant may include a linear alkoxylated alcohol. Without wishing to be bound by theory, it is believed that linear alkoxylated alcohols, compared to branched alkoxylated alcohols, are characterized by increased packing efficiency and facilitate smaller average particle sizes in the nanoemulsions.

The nonionic surfactant may be characterized by HLB (hydrophilic-lipophilic balance). Total HLB (hydrophilic-lipophilic balance) of the nonionic surfactant that is used may be in the range of from about 8 to about 16, or in the range of from about 10 to about 15. When the nanoemulsion includes first and second nonionic surfactants, the first nonionic surfactant may be characterized by a first HLB value, the second nonionic surfactant may characterized by a second HLB value, and the amino silicone may be characterized by a third HLB value that is between the first HLB value and the second HLB value. Without wishing to be bound by theory, it is believed that selecting a combination of nonionic surfactants that are characterized by HLB values both greater and less than the HLB of the amino silicone, which may have an HLB value of about 10 to about 13. The first HLB value may be from about 8 to about 12. The second HLB value may be from about 10 to about 16. As used in the present disclosure, HLB is determined according to the Griffin method on a 0 to 20 scale.

Commercially available nonionic surfactants suitable for the present composition may include be Tergitol 15-S® series (Dow Chemical, Midland, Mich.), Tergitol TMN® series (Dow Chemical, Midland, Mich.), linear alcohol ethoxylates such as the Neodol® series (Shell Chemical, Houston, Tex.), the Tomadol® series (Air Products, Allentown, Pa.), or the Surfonic® L series (Huntsman Chemical, Salt Lake City, Utah). Specific examples include Tergitol 15-S-5, Tergitol 15-S-12, Tergitol TMN-3, Tergitol TMN-6, Tergitol TMN-10, Neodol 23-3, Neodol 23-5, Neodol 25-7, Neodol 25-9, Neodol 45-7, and Neodol 45-9.

Cationic Surfactants

Cationic surfactants include, for example, alkyl trimethylammonium chloride, alkylamine hydrochloric acid salts, alkylamine acetate, alkylbenzene dimethyl ammonium chloride and the like.

Non-limiting examples of cationic surfactants include: the quaternary ammonium surfactants, which can have up to 26 carbon atoms include: alkoxylate quaternary ammonium (AQA) surfactants as discussed in U.S. Pat. No. 6,136,769; dimethyl hydroxyethyl quaternary ammonium as discussed in 6,004,922; dimethyl hydroxyethyl lauryl ammonium chloride; polyamine cationic surfactants as discussed in WO 98/35002, WO 98/35003, WO 98/35004, WO 98/35005, and WO 98/35006; cationic ester surfactants as discussed in U.S. Pat. Nos. 4,228,042, 4,239,660 4,260,529 and U.S. Pat. No. 6,022,844; and amino surfactants as discussed in U.S. Pat. No. 6,221,825 and WO 00/47708, specifically amido propyldimethyl amine (APA).

Anionic Surfactants

Suitable anionic surfactants include sulphate and sulphonate surfactants. Suitable sulphonate surfactants include alkyl benzene sulphonate, in one aspect, $C_{10-13}$ alkyl benzene sulphonate. Suitable alkyl benzene sulphonate (LAS) may be obtained, by sulphonating commercially available linear alkyl benzene (LAB); suitable LAB includes low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®. A suitable anionic surfactant is alkyl benzene sulphonate that is obtained by DETAL catalyzed process, although other synthesis routes, such as HF, may also be suitable. In one aspect a magnesium salt of LAS is used.

Suitable sulphate surfactants include alkyl sulphate, or, $C_{8-18}$ alkyl sulphate, or predominantly $C_{12}$ alkyl sulphate.

Another suitable sulphate surfactant is alkyl alkoxylated sulphate, in one aspect, alkyl ethoxylated sulphate, in one aspect, a $C_{8-18}$ alkyl alkoxylated sulphate, in another aspect, a $C_{8-18}$ alkyl ethoxylated sulphate, typically the alkyl alkoxylated sulphate has an average degree of alkoxylation of from 0.5 to 20, or from 0.5 to 10, typically the alkyl alkoxylated sulphate is a $C_{8-18}$ alkyl ethoxylated sulphate having an average degree of ethoxylation of from 0.5 to 10, from 0.5 to 7, from 0.5 to 5 or even from 0.5 to 3.

The alkyl sulphate, alkyl alkoxylated sulphate, and alkyl benzene sulphonates may be linear or branched, substituted or un-substituted.

The surfactant may be a mid-chain branched surfactant, in one aspect, a mid-chain branched anionic detersive surfactant, in one aspect, a mid-chain branched alkyl sulphate and/or a mid-chain branched alkyl benzene sulphonate, for example a mid-chain branched alkyl sulphate. In one aspect, the mid-chain branches are $C_{1-4}$ alkyl groups, typically methyl and/or ethyl groups.

Zwitterionic Surfactants

Examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 at column 19, line 38 through column 22, line 48, for examples of zwitterionic surfactants; betaines, including alkyl dimethyl betaine and cocodimethyl amidopropyl betaine, $C_8$ to $C_{18}$ (for example from $C_{12}$ to $C_{18}$) amine oxides. and sulfo and hydroxy betaines, such as Alkyl-N,N-dimethylammino-1-propane sulfonate where the alkyl group can be $C_8$ to $C_{18}$ and in certain embodiments from $C_{10}$ to $C_{14}$.

Ampholytic Surfactants

Specific, non-limiting examples of ampholytic surfactants include: aliphatic derivatives of secondary or tertiary amines, or aliphatic derivatives of heterocyclic secondary and tertiary amines in which the aliphatic radical can be straight- or branched-chain. One of the aliphatic substituents may contain at least about 8 carbon atoms, for example from about 8 to about 18 carbon atoms, and at least one contains an anionic water-solubilizing group, e.g. carboxy, sulfonate, sulfate. See U.S. Pat. No. 3,929,678 at column 19, lines 18-35, for suitable examples of ampholytic surfactants.

Amphoteric Surfactants

Amphoteric surfactants include, for example, N-acylamidopropyl-N,N-dimethyl ammonia betaines, N-acylamidopropyl-N,N'-dimethyl-N'-β-hydroxypropyl ammonia betaines, and the like.

Examples of amphoteric surfactants include: aliphatic derivatives of secondary or tertiary amines, or aliphatic derivatives of heterocyclic secondary and tertiary amines in which the aliphatic radical can be straight- or branched-chain. One of the aliphatic substituents contains at least about 8 carbon atoms, typically from about 8 to about 18 carbon atoms, and at least one contains an anionic water-solubilizing group, e.g. carboxy, sulfonate, sulfate. Examples of compounds falling within this definition are sodium 3-(dodecylamino)propionate, sodium 3-(dodecylamino) propane-1-sulfonate, sodium 2-(dodecylamino) ethyl sulfate, sodium 2-(dimethylamino) octadecanoate, disodium 3-(N-carboxymethyldodecylamino)propane 1-sulfonate, disodium octadecyl-imminodiacetate, sodium 1-carboxymethyl-2-undecylimidazole, and sodium N,N-bis(2-hydroxyethyl)-2-sulfato-3-dodecoxypropylamine See U.S. Pat. No. 3,929,678 to Laughlin et al., issued Dec. 30, 1975 at column 19, lines 18-35, for examples of amphoteric surfactants.

Protonating Agent

The nanoemulsions of the present disclosure may include a protonating agent. The protonating agent is may be a monoprotic or multiprotic, water-soluble or water-insoluble, organic or inorganic acid. Suitable protonating agents include, for example, formic acid, acetic acid, propionic acid, malonic acid, citric acid, hydrochloric acid, sulfuric acid, phosphoric acid, nitric acid, or a mixture thereof. The protonating agent may be selected from formic acid, acetic acid, or a mixture thereof. The protonating agent may be acetic acid, for example glacial acetic acid.

Generally, the acid is added in the form of an acidic aqueous solution. The protonating agent may be added in an amount necessary to achieve a nanoemulsion pH of from about 3.5 to about 7.0. The amino silicone nanoemulsions may include the protonating agent in an amount necessary to achieve a pH of from about 3.5 to about 6.5, or from about 4.0 to about 6.0, or from about 5.0 to about 6.0, or about 5.5. The amino silicone nanoemulsions may include from about 0.1% to about 5%, or from about 0.2% to about 2%, or from about 0.5% to about 1% of the protonating agent, by weight of the nanoemulsion.

Water

The amino silicone nanoemulsion may include from about 10% to about 95%, or from about 25% to about 90%, or from about 40% to about 85%, or from about 60% to about 80%, of water, by weight of the nanoemulsion. Typically, most of the water is found in the bulk phase of the nanoemulsion.

Stabilizer

The amino silicone nanoemulsions may also comprise auxiliary stabilizers selected from mono- or polyalcohols and ethers thereof, which have a boiling point or boiling range of at most 260° C. at 0.10 MPa. Examples of monoalcohols are ethanol, n-propanol, isopropanol and butanol. Examples of polyalcohols are ethylene glycol and propylene glycol. Examples of polyalcohol ethers are ethylene glycol monobutyl ether, ethylene glycol monoethyl ether and diethylene glycol monoethyl ether. If used, the nanoemulsions may include auxiliary stabilizers at levels up to about 10%. Certain embodiments of the nanoemulsions optionally comprise from about 1% to about 7%, while others optionally comprise from about 2% to about 5% of the auxiliary stabilizer.

The emulsions of the present disclosure may be substantially free of additional stabilizers.

Optional Nanoemulsion Adjunct Ingredients

The amino silicone nanoemulsions may additionally include further substances, such as preservatives, scents, corrosion inhibitors and dyes. Examples of preservatives are alcohols, formaldehyde, parabens, benzyl alcohol, propionic acid and salts thereof and also isothiazolinones. The nanoemulsions may further include yet other additives, such as non-silicon-containing oils and waxes. Examples thereof are rapeseed oil, olive oil, mineral oil, paraffin oil or non-silicon-containing waxes, for example carnauba wax and candelilla wax or montan acid and montan ester waxes, incipiently oxidized synthetic paraffins, polyethylene waxes, polyvinyl ether waxes and metal-soap-containing waxes. The amino silicone nanoemulsions further comprise carnauba wax, paraffin wax, polyethylene wax, or a mixture thereof. The nanoemulsions may comprise up to about 5% by weight of the nanoemulsion or from about 0.05% to about 2.5% by weight of the nanoemulsion of such further substances.

Method of Making

The amino silicone nanoemulsions may be beneficial because that may be made with simpler, less-energy-intensive methods than traditional nanoemulsions, in part due to the selection of internal phase diluent. Thus, the present disclosure relates to methods of making silicone nanoemulsions.

The amino silicone nanoemulsions may be made by a method that includes the steps of: mixing the amino silicone with the internal phase diluent; adding the surfactant system, the protonating agent, and water; and mixing. The mixture may be mixed using an energy density of less than about 4 $kW/m^3$, or less than about 3 $kW/m^3$, or less than about 2.5 $kW/m^3$, or less than about 2 $kW/m^3$, or less than about 1.5 $kW/m^3$, or less than about 1 $kW/m^3$. Mixing with lower energy densities can be energy and/or cost efficient, so long as a desired average particle size is provided.

The method may include the steps, in order, of combining the amino silicone and internal phase diluent and mixing; mixing in the surfactant system; mixing in the protonating agent; and mixing in the water. The water may be added in a series of additions, for example in three additions of roughly equal volumes of water.

The method may include using a mixing system selected from an overhead mixer, a high shear mixer, a high pressure homogenizer, a colloid mill, a microfluidizer, or combinations thereof. The method may include using a mixing system that comprises an overhead mixer, which may deliver an energy density of less than about 4 $kW/m^3$, or less than about 3 $kW/m^3$, or less than about 2.5 $kW/m^3$, or less than about 2 $kW/m^3$, or less than about 1.5 $kW/m^3$, or less than about 1 $kW/m^3$.

Treatment Composition

The amino silicone nanoemulsions of the present invention may be incorporated into treatment compositions or cleaning compositions, such as, but not limited to, a fabric care composition, a dish cleaning composition, a home care composition, a beauty care composition, or a personal care composition. In some aspects, the treatment composition comprises from about 0.001% to about 99% by weight of the composition, of the amino silicone nanoemulsion. In certain aspects, the treatment composition comprises from about 0.001% to about 15% of the amino silicone nanoemulsion, by weight of the composition.

Examples of treatment and cleaning compositions include, but are not limited to, liquid laundry detergents, solid laundry detergents, laundry soap products, laundry spray treatment products, laundry pre-treatment products, fabric enhancer products, hand dish washing detergents, automatic dishwashing detergents, a beauty care detergent, hard surface cleaning detergents (hard surfaces include exterior surfaces, such as vinyl siding, windows, and decks), carpet cleaning detergents, conditioners, a shampoo, shave preparation products, and a household cleaning detergent. Examples of fabric care compositions suitable for the present disclosure include, but are not limited to, liquid laundry detergents, heavy duty liquid laundry detergents, solid laundry detergents, laundry soap products, laundry spray treatment products, laundry pre-treatment products, laundry soak products, heavy duty liquid detergents, and rinse additives. Examples of suitable dish cleaning compositions include, but are not limited to, automatic dishwasher detergents, detergents for hand washing of dishes, liquid dish soap, and solid granular dish soap. Examples of suitable home care compositions include, but are not limited to, rug or carpet cleaning compositions, hard surface cleaning detergents, floor cleaning compositions, window cleaning compositions, household cleaning detergents, and car washing detergents. Examples of suitable personal care compositions include, but are not limited to, beauty care cleansers, such as hair and skin cleansers, beauty bars, bar soap, bath beads, bath soaps, hand washing compositions, body washes and soaps, shampoo, conditioners, cosmetics, hair removal compositions, and oral care compositions.

In some aspects, the treatment composition may be provided in combination with a nonwoven substrate, as a treatment implement.

In certain aspects, the compositions provide water and/or oil repellency to the treated surface, thereby reducing the propensity of the treated surface to become stained by deposited water- or oil-based soils.

By "surfaces" it is meant any surface. These surfaces may include porous or non-porous, absorptive or non-absorptive substrates. Surfaces may include, but are not limited to, celluloses, paper, natural and/or synthetic textiles fibers and fabrics, imitation leather and leather, hair and skin. Selected aspects of the present invention are applied to natural and/or synthetic textile fibers and fabrics.

By "treating a surface" it is meant the application of the composition onto the surface. The application may be performed directly, such as spraying or wiping the composition onto a hard surface. The composition may or may not be rinsed off, depending on the desired benefit.

The present invention also encompasses the treatment of a fabric as the surface. This can be done either in a "pretreatment mode", where the composition is applied neat onto the fabric before the fabrics are washed or rinsed, or a "post-treatment mode", where the composition is applied neat onto the fabric after the fabric is washed or rinsed. The treatment may be performed in a "soaking mode", where the fabric is immersed and soaked in a bath of neat or diluted composition. The treatment may also be performed in a "through the wash" or "through the rinse" mode where the treatment composition, as defined herein, is added to the wash cycle or the rinse cycle of a typical laundry wash machine cycle. When used in the wash or rinse cycle, the compositions are typically used in a diluted form. By "diluted form" it is meant that the compositions may be diluted in the use, preferably with water at a ratio of water to composition up to 500:1, or from 5:1 to 200:1, or from 10:1 to 80:1.

Such treatment compositions may comprise carriers, which may be any known material that is useful in delivering the treatment compositions to the surface to be treated. The carrier may be as simple as a single component delivery vehicle, such as water or alcohol, which would allow the nanoemulsion to be sprayed onto a surface. Alternatively, the carrier may be complex, such as a cleaning composition, e.g., a laundry detergent where the nanoemulsion would be applied in conjunction with the other beneficial uses of the complex carrier.

Such treatment compositions may comprise various other materials, including bleaching agents, bleach activators, detersive surfactants, builders, chelating agents, smectite clays, dye transfer inhibiting agents, dispersants, enzymes, and enzyme stabilizers, catalytic metal complexes, polymeric dispersing agents, clay and soil removal/anti-redeposition agents, brighteners, suds suppressors, suds boosters, dyes, additional perfumes and perfume delivery systems, structure elasticizing agents, fabric softeners, carriers, hydrotropes, processing aids and/or pigments.

Detersive Surfactants—The treatment compositions according to the present disclosure may comprise a detersive surfactant or detersive surfactant system. Suitable detersive surfactants include nonionic surfactant, anionic surfactant, cationic surfactant, ampholytic surfactant, zwitterionic surfactant, semi-polar nonionic surfactant, or a mixture thereof. The detersive surfactant is typically present at a level of from about 0.1%, from about 1%, or even from about 5%, by weight of the treatment composition, to about 99.9%, to about 80%, to about 35%, or even to about 30%, by weight of the treatment composition. The specific surfactants described above, in the context of the nanoemulsion itself, may be included in the treatment compositions as detersive surfactants. When included in the treatment compositions (as opposed to the nanoemulsion itself), these surfactants are generally included at appropriate concentrations such that the surfactants provide a detersive or cleaning benefit.

Builders—The treatment compositions of the present disclosure may comprise one or more detergent builders or builder systems. When present, the compositions will typically comprise at least about 1% builder, or from about 5% or 10% to about 80%, 50%, or even 30% by weight, of said builder. Builders include, but are not limited to, the alkali metal, ammonium and alkanolammonium salts of polyphosphates, alkali metal silicates, alkaline earth and alkali metal carbonates, aluminosilicate builders polycarboxylate compounds, ether hydroxypolycarboxylates, copolymers of maleic anhydride with ethylene or vinyl methyl ether, 1,3,5-trihydroxybenzene-2,4,6-trisulphonic acid, and carboxymethyl-oxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Chelating Agents—The treatment compositions may also optionally contain one or more copper, iron and/or manganese chelating agents. If utilized, chelating agents will generally comprise from about 0.1% by weight of the compositions herein to about 15%, or even from about 3.0% to about 15% by weight of the compositions herein.

Dye Transfer Inhibiting Agents—The treatment compositions of the present disclosure may also include one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole (PVPVI), polyvinyloxazolidones and polyvinylimidazoles or mixtures thereof. When present in the compositions herein, the dye transfer inhibiting agents are present at levels from about 0.0001%, from about 0.01%, from about 0.05% by weight of the cleaning compositions to about 10%, about 2%, or even about 1% by weight of the cleaning compositions.

Dispersants—The treatment compositions of the present disclosure may also contain dispersants. Suitable water-soluble organic materials are the homo- or co-polymeric acids or their salts, in which the polycarboxylic acid may comprise at least two carboxyl radicals separated from each other by not more than two carbon atoms.

Enzymes—The treatment compositions may comprise one or more detergent enzymes, which provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, lignin-ases, pullulanases, tannases, pentosanases, malanases, β-glucanases, arabinosidases, hyaluronidase, chondroitinase, laccase, and amylases, or mixtures thereof. A typical combination is a cocktail of conventional applicable enzymes like protease, lipase, cutinase and/or cellulase in conjunction with amylase.

Enzyme Stabilizers—Enzymes for use in the treatment compositions, e.g., detergents, may be stabilized by various techniques. The enzymes employed herein can be stabilized by the presence of water-soluble sources of calcium and/or magnesium ions in the finished compositions that provide such ions to the enzymes.

In some aspects, the treatment composition comprises an amino silicone nanoemulsion and a carrier. Typically, the amino silicone nanoemulsion is substantially free of a silicone resin. In some aspects, the treatment composition comprises an amino silicone nanoemulsion, a carrier, and a perfume, a detersive surfactant system, or a cleaning adjunct additive. The detersive surfactant system may comprise one or more surfactants selected from nonionic surfactants, cationic surfactants, anionic surfactants, zwitterionic surfactants, ampholytic surfactants, or amphoteric surfactants. In some aspects, the detersive surfactant system comprises a surfactant selected from $C_{10}$-$C_{16}$ alkyl benzene sulfonates, $C_8$-$C_{18}$ alkyl sulfate, $C_8$-$C_{18}$ alkyl ethoxylated sulfate, or a mixture thereof.

In certain aspects of the present disclosure, the treatment composition is a fabric care composition. Such a fabric care composition may take the form of detergent composition or a rinse added fabric conditioning compositions. Such compositions may comprise a fabric softening active and a dispersant polymer, to provide a stain repellency benefit to fabrics treated by the composition, typically from about 0.00001 wt. % (0.1 ppm) to about 1 wt. % (10,000 ppm), or even from about 0.0003 wt. % (3 ppm) to about 0.03 wt. % (300 ppm) based on total rinse added fabric conditioning composition weight. In another specific aspect, the compositions are rinse added fabric conditioning compositions. Examples of typical rinse added conditioning composition can be found in U.S. Provisional Patent Application Ser. No. 60/687,582 filed on Oct. 8, 2004.

In some aspects, the treatment composition is encapsulated in a water-soluble or water-dispersible pouch. The water-soluble film or pouch may comprise polyvinyl alcohol, polyvinyl acetate, or mixtures thereof. In some aspects, the unit dose form comprises at least two compartments, or at least three compartments. At least one compartment may be superimposed on another compartment.

The treatment composition may be in the form of a granule. Granular treatment compositions may include any number of conventional detergent ingredients, such as the components described above, e.g., surfactants, chelants, enzymes. Granular detergent compositions typically comprise from about 1% to 95% by weight of a surfactant. Granular detergents can be made by a wide variety of processes, non-limiting examples of which include spray drying, agglomeration, fluid bed granulation, marumarisation, extrusion, or a combination thereof. Bulk densities of granular detergents generally range from about 300 g/l-1000 g/l. The average particle size distribution of granular detergents generally ranges from about 250 microns-1400 microns.

The treatment composition disclosed herein may be selected from a beauty care composition, a hand washing composition, a body wash composition, a shampoo composition, a conditioner composition, a cosmetic composition, a hair removal composition, a oral care composition, a laundry spray composition, a laundry rinse additive composition, a liquid laundry detergent compositions, a solid laundry detergent compositions, a hard surface cleaning compositions, a liquid hand dishwashing compositions, a solid automatic dishwashing compositions, a liquid automatic dishwashing, and a tab/unit dose form automatic dishwashing compositions, and a laundry detergent compositions contained in a water-soluble pouch.

Method of Making Treatment Composition Comprising Amino Silicone Nanoemulsion

The present disclosure relates to methods of making treatment compositions that include the amino silicone nanoemulsions described herein. The method may include the steps of providing a base composition and mixing in the amino silicone nanoemulsion. The base composition may include anionic surfactant and optionally nonionic surfactant, which may result in a treatment composition that can provide both cleaning and softness benefits.

The treatment compositions disclosed herein may be prepared by combining the components thereof in any convenient order and by mixing, e.g., agitating, the resulting component combination to form a phase stable treatment composition.

A liquid matrix may be formed containing at least a major proportion, or even substantially all, of the liquid components, e.g., nonionic surfactant, the non-surface active liquid carriers and other optional liquid components, with the liquid components being thoroughly admixed by imparting shear agitation to this liquid combination. For example, rapid stirring with a mechanical stirrer may usefully be employed. While shear agitation is maintained, substantially all of any anionic surfactant and the solid ingredients can be added. Agitation of the mixture is continued, and if necessary, can be increased at this point to form a solution or a uniform dispersion of insoluble solid phase particulates within the liquid phase. After some or all of the solid-form materials have been added to this agitated mixture, particles of any enzyme material to be included, e.g., enzyme prills are incorporated. As a variation of the composition preparation procedure described above, one or more of the solid components may be added to the agitated mixture as a solution or slurry of particles premixed with a minor portion of one or more of the liquid components. After addition of all of the composition components, agitation of the mixture is continued for a period of time sufficient to form compositions having the requisite viscosity and phase stability characteristics. Frequently this will involve agitation for a period of from about 30 to 60 minutes.

The amino silicone nanoemulsion may first be combined with one or more liquid components to form an aqueous amino silicone nanoemulsion premix, and this aqueous amino silicone nanoemulsion premix is added to a base composition formulation containing a substantial portion, for example more than 50% by weight, more than 70% by weight, or even more than 90% by weight, of the balance of components of the cleaning composition. For example, in the methodology described above, both the aqueous amino silicone nanoemulsion premix and the enzyme component are added at a final stage of component additions. In another aspect, the aqueous amino silicone nanoemulsion is encapsulated prior to addition to the detergent composition, the encapsulated aqueous amino silicone nanoemulsion is suspended in a structured liquid, and the suspension is added to a composition formulation containing a substantial portion of the balance of components of the cleaning composition.

Methods of Using Treatment Compositions

The treatment compositions of the present disclosure may be used in a method of treating a surface. The method of treating a surface may include the step of applying the treatment compositions of the present disclosure to a surface, for example where the surface is selected from fabric, skin, hair, or a hard surface. The applying step may occur in the presence of water, for example a wash liquor in an automatic washing machine.

Test Methods

Average Particle Size Method

The average particle size of the silicone emulsions is determined by using the flow cell measuring capabilities of a Horiba Light Scattering Particle Size and Distribution Analyzer, model LA-950 (Horiba Instruments, Inc., Irvine, Calif.). The software and instrument is set up as follows for data gathering and analysis.

The corresponding software and data analysis package are version 3.73. Set the sample background Refractive Index (RI) value to 1.40.

Prior to collecting sample data, fill the water basin with enough DI water to enable collection of multiple data runs—approximately 4 L. Ensure the flow cell is correctly attached and aligned according to the manufacturer's instructions.

In Measurement view mode, rinse the instrument at least twice using the "rinse" function to remove any background debris. After rinsing, click on the feed button on the upper left side of the instrument Measurement view panel to dispense water into the instrument using the low fill preset water levels. Click on the Alignment button. Set values for Circulation (3) and Agitation (3) and turn each of these features on. Set the blank for the instrument by clicking the Blank button under the Alignment button.

After setting the blank, silicone emulsion sample measurements are ready to be taken. Open the sample reservoir door and ensure the water in the reservoir is circulating. Add the silicone emulsion, one drop at a time, directly to the sample reservoir, allowing some time for system equilibration. Continue adding emulsion until the Red, and preferably the Blue column, on the right side of the Measurement view screen are in the green acceptable range. The Red column measures percent transmittance (% T) for samples having small particle sizes at a preset wavelength of light, and the Blue column measures % T for samples having large particle sizes. The acceptable % T ranges are between 80% and 95%. For some samples that have small particle sizes, it may not be possible to have both the Red and Blue columns in the acceptable range; for such samples, enough emulsion is added for the Red column to be in the acceptable range.

When enough emulsion has been added to the flow cell to produce an acceptable % T for at least the Red column, click on the Measure button below the Blank button. When prompted for sample information and measurement conditions, the following settings are used:

i. Form of Distribution=Manual ii. Number of Iterations=150 iii. Data distribution mode Volume or Number=Volume

Press Start to begin data collection. Select "yes" when prompted to overwrite the existing data. After sample data collection, a result table will appear in a printable format. The "average particle size" of the present emulsions corresponds to the "mean size" according to the result table.

Percentage Transmittance Method

The percent transmittance is determined by measuring the percentage of light transmittance through samples using a UV-Vis Spectrophotometer operated in transmission mode, at 480 nm, using 1 cm path length cuvettes, in accordance with the following procedure. Suitable instruments include the Beckman Coulter model DU 800 UV-Vis Spectrophotometer (Beckman Coulter Inc., Brea, Calif., USA).

All sample preparations and analyses are conducted in a laboratory with air temperature of 22° C.+/−2° C.

Turn on the spectrophotometer lamps and allow them to warm up for 30 minutes prior to commencing measurements. Set the instrument to collect the measurement in Percentage Transmission (% T) mode, at a wavelength of 480 nm Load all sample emulsions into 1 cm path length plastic cuvettes. If air bubbles are visible in the cuvettes, use a pipette to remove the bubbles, or let the bubbles settle out of the cuvette prior to measurement.

Zero the baseline of the spectrophotometer by using a cuvette loaded with deionized (DI) water. Measure the % T of the DI water sample. The instrument should read 100% T; if it does not, then re-zero the instrument using the same cuvette of DI Water. Measure the % T of the silicone emulsion sample and record its value.

Miscibility Method

In order to qualitatively gauge the miscibility of solvents with the silicone polymer to be emulsified, equal portions of silicone fluid and solvent are added to a 20 mL scintillation vials or graduated cylinders of a similar volume and are mixed by vigorous shaking by hand or by using a vortex mixer for approximately 30-45 seconds. After shaking, the sample is allowed to settle and de-aerate for at least 1 hour at room temperature.

After settling, if no apparent phase separation is noted, then the solvent is completely miscible (100%) with the silicone polymer. If there are separation layers apparent, measure the height of each layer and calculate the % separation for each layer relative to the starting volume of that layer.

For example, consider a sample that comprises 5 g of silicone and 5 g of solvent in a 10 mL graduated cylinder. If, after mixing, a separation boundary exists at the 7 mL mark, that solvent is said to be 40% miscible with the silicone (i.e., 2 g (out of the initial 5 g) of solvent is miscible with the silicone). Separation will be characterized by distinct phase boundaries formed between layers or the appearance of haziness in one or more of the layers.

EXAMPLES

Nanoemulsion Preparations

Nanoemulsions according to the present disclosure may be prepared as described in Examples 1, 2, and 3 below. Example 4 describes a comparative emulsion.

Example 1

Preparation of 20% active Amino Silicone Nanoemulsion using tripropylene glycol n-butyl ether (TPnB) solvent. In a suitably sized container (e.g., a 250 mL beaker), add 80.0 g of MagnaSoft® Plus Aminosilicone fluid (Momentive Silicones, Waterford, N.Y.) and 20.0 g Tripropyleneglycol n-butyl ether solvent (Sigma Aldrich, St. Louis, Mo.) and mix thoroughly to ensure complete incorporation of solvent into silicone fluid. Dispense 20.0 g of this mixture into a separate 250 mL beaker. To the mixture in the separate 250 mL beaker, add 1.0 g Tergitol™ 15-S-5 surfactant and 1.0 g Tergitol™ 15-S-12 surfactant (both from Dow Chemical, Midland Mich.), then mix slowly using an Ika RWA-20 overhead mixer with a stainless steel 4-blade mixer (each blade being offset by 45° relative to the mixer shaft and measuring 20 mm×8 mm) at less than 100 rpm. Once the mixture has been thoroughly mixed as judged by its thick milky appearance, slowly add 0.8 g Glacial Acetic Acid (Sigma Aldrich, St. Louis, Mo.) to the mixture with continuous mixing. Add 25.7 g DI Water to the mixture slowly at a rate of about 10 mL per minute with constant stirring at no more than 100 rpm. Allow to mix for about 10 minutes to ensure all of the water has been incorporated then add an additional 25.7 g DI Water as before. After that water addition has been fully incorporated add the final 25.7 g DI Water as before and continue mixing with low agitation speed (no more than 100 rpm) for approximately 20 minutes. The average particle size of the resulting emulsion is about 70-90 nm, measured according to the method disclosed herein.

Example 2

Preparation of 27% active Aminosilicone Nanoemulsion using Propyleneglycol n-butyl ether. In a suitably sized container (i.e., a 250 mL beaker), add 80.0 g of MagnaSoft® Plus Aminosilicone fluid (Momentive Silicones, Waterford, N.Y.) and 20.0 g Propyleneglycol n-butyl ether solvent (Sigma Aldrich, St. Louis, Mo.) and mix thoroughly to ensure complete incorporation of solvent into silicone fluid. Dispense 33.75 g of this mixture into a separate 250 mL beaker. To the mixture in the separate 250 mL beaker, add 1.0 g Tergitol™ 15-S-5 surfactant and 1.0 g Tergitol™ 15-S-12 surfactant (both from Dow Chemical, Midland Mich.), then mix slowly using an Ika RWA-20 overhead mixer with a stainless steel 4-blade mixer (each blade being offset by 45° relative to the mixer shaft and measuring 20 mm×8 mm) at less than 100 rpm. Once the mixture has been thoroughly mixed as judged by its thick milky appearance, slowly add 0.8 g Glacial Acetic Acid (Sigma Aldrich, St. Louis, Mo.) to the mixture with continuous mixing. Add 21.15 g DI Water to the mixture slowly at a rate of about 10 mL per minute with constant stirring at no more than 100 rpm. Allow to mix for about 10 minutes to ensure all of the water has been incorporated then add an additional 21.15 g DI Water as before. After that water addition has been fully incorporated add the final 21.15 g DI Water as before and continue mixing with low agitation speed (no more than 100 rpm) for approximately 20 minutes. The average particle size of the resulting emulsion is about 80-110 nm.

Example 3

Preparation of 27% active Aminosilicone Nanoemulsion using Propyleneglycol n-butyl ether. Follow the same procedure for making Example 2 above, substituting 1.84 g of Tomadol® 45-7 NI surfactant (Air Products, Inc., Allentown, Pa.) for Tergitol™ 15-S-5, and 0.86 g Surfonic® L 24-9 surfactant (Huntsman Chemical, Salt Lake City, Utah) for Tergitol™ 15-5-12. Add water in three separate aliquots of 20.9 g each. The average particle size of the resulting emulsion is about 80-100 nm.

Example 4

Preparation of a comparative 20% active Amino Silicone Nanoemulsion using 2-Ethyl hexanol solvent. Follow the procedure for emulsion making in Example 1, substituting 2-Ethyl hexanol (Sigma Aldrich, St. Louis, Mo.) for Tripropyleneglycol n-butyl ether. The average particle size of the resulting emulsion is about 1-1.5 um.

Example 5

Internal Diluent Selection. Silicone (nano)emulsions are made with various internal phase diluents. Data Table 1, below, shows the effect of internal phase diluent selection on various properties of the silicone nanoemulsion properties. In the formulations, the ratio of silicone to internal phase diluent is about 4:1, and the ratio of surfactant to silicone is about 10:1. In the present table, a nanoemulsion is determined to "pass" if the average particle size is less than 250 nm and if the emulsion is stable. Average particle size is measured with a Horiba LA700 machine using a flow cell apparatus according to the method described herein.

DATA TABLE 1

| Internal phase diluents | Approximate Miscibility* of diluent in Aminosilicone | Emulsion Concentration, as % Si | Emulsion Avg. Particle Size (nm) | Emulsion Stability | Pass/ Fail |
|---|---|---|---|---|---|
| Tripropylene glycol n-butyl ether | 40% | 20% | 80 | Stable | Pass |
| Dipropylene glycol n-butyl ether | 70% | 20% | 70 | Stable | Pass |
| Propylene glycol n-butyl ether | 100% | 30% | 70 | Stable | Pass |
| Diethylene glycol n-butyl ether | 20% | 17%** | n/a | Unstable | Fail |
| Isopropyl Alcohol | 100% | 20%** | n/a | Unstable | Fail |
| Ethanol | 100% | 20%** | n/a | Unstable | Fail |
| 2-Ethyl hexanol | 100% | 20% | 1,000 | Stable | Fail |

*Based upon approximate miscibility using Miscibility Method described above
**Targeted formulation silicone levels Without wishing to be bound by theory, the selection of solvent for use as an internal phase diluent is driven by more than just miscibility with the silicone polymer to be emulsified. The solvent must be compatible with the silicone, but also not lower the surface tension to a point where emulsification is impossible (as in the case with alcohols like Isopropyl alcohol and Ethanol). Additionally, some solvents lack the ability to work with the surfactant system to help further reduce the surfactant packing efficiency resulting in larger emulsion droplet sizes (as in the case of 2-Ethyl hexanol). Notably, each of the propylene glycol n-butyl ethers resulted in silicone nanoemulsions that "passed," while the nanoemulsion comprising diethylene glycol n-butyl ether "failed." Further, the monopropylene glycol n-butyl ether facilitated a higher silicone content than the other internal phase diluents.

Example 6

Liquid Detergent Fabric Care Compositions. Liquid detergent fabric care composition 6A-6E are made by mixing together the ingredients listed in the proportions shown:

| Ingredient (wt %) | 6A | 6B | 6C | 6D | 6E |
|---|---|---|---|---|---|
| $C_{12}$-$C_{15}$ alkyl polyethoxylate (1.8) sulfate[1] | 20.1 | 16.6 | 14.7 | 13.9 | 8.2 |
| $C_{11.8}$ linear alkylbenzene sulfonc acid[2] | — | 4.9 | 4.3 | 4.1 | 8.2 |
| $C_{16}$-$C_{17}$ branched alkyl sulfates[1] | — | 2.0 | 1.8 | 1.6 | — |
| $C_{12}$ alkyl trimethyl ammonium chloride[4] | 2.0 | | — | — | — |
| $C_{12}$ alkyl dimethyl amine oxides[5] | | 0.7 | 0.6 | — | — |
| $C_{12}$-$C_{14}$ alcohol 9 ethoxylate[3] | 0.3 | 0.8 | 0.9 | 0.6 | 0.7 |
| $C_{15}$-$C_{16}$ branched alcohol -7 ethoxylate[1] | — | — | — | — | 4.6 |
| 1,2 Propane diol[6] | 4.5 | 4.0 | 3.9 | 3.1 | 2.3 |
| Ethanol | 3.4 | 2.3 | 2.0 | 1.9 | 1.2 |
| $C_{12}$-$C_{18}$ Fatty Acid[5] | 2.1 | 1.7 | 1.5 | 1.4 | 3.2 |
| Citric acid[7] | 3.4 | 3.2 | 3.5 | 2.7 | 3.9 |
| Protease[7] (32 g/L) | 0.42 | 1.3 | 0.07 | 0.5 | 1.12 |
| Fluorescent Whitening Agent[8] | 0.08 | 0.2 | 0.2 | 0.17 | 0.18 |
| Diethylenetriamine pentaacetic acid[6] | 0.5 | 0.3 | 0.3 | 0.3 | 0.2 |
| Ethoxylated polyamine[9] | 0.7 | 1.8 | 1.5 | 2.0 | 1.9 |
| Grease Cleaning Alkoxylated Polyalkylenimine Polymer[10] | — | — | 1.3 | 1.8 | — |
| Zwitterionic ethoxylated quaternized sulfated hexamethylene diamine[11] | — | 1.5 | — | — | 0.8 |
| Hydrogenated castor oil[12] | 0.2 | 0.2 | | 0.12 | 0.3 |
| Copolymer of acrylamide and methacrylamidopropyl trimethylammonium chloride[13] | 0.3 | 0.2 | 0.3 | 0.1 | 0.3 |
| Silicone emulsion of any of Examples 1-3 (mixtures thereof may also be used) | 0.5-4.0 | 0.5-4.0 | 0.5-4.0 | 0.5-4.0 | 0.5-4.0 |
| Water, perfumes, dyes, buffers, solvents and other optional components | to 100% pH 8.0-8.2 | to 100% pH 8.0-8.2 | to 100% pH 8.0-8.2 | to 100% pH 8.0-8.2 | to 100% pH 8.0-8.2 |

Example 7

Liquid or Gel Detergents. Liquid or gel detergent fabric care compositions 7A-7G are prepared by mixing the ingredients listed in the proportions shown:

| Ingredient (wt %) | 7A | 7B | 7C | 7D | 7E | 7F | 7G |
|---|---|---|---|---|---|---|---|
| $C_{12}$-$C_{15}$ alkyl polyethoxylate (3.0) sulfate[1] | 8.5 | 2.9 | 2.9 | 2.9 | 6.8 | 9.1 | 9.1 |
| $C_{11.8}$ linear alkylbenzene sulfonic acid[2] | 11.4 | 8.2 | 8.2 | 8.2 | 1.2 | 5.7 | 5.7 |
| $C_{14}$-$C_{15}$ alkyl 7-ethoxylate[1] | — | 5.4 | 5.4 | 5.4 | 3.0 | | |
| $C_{12}$-$C_{14}$ alkyl 7-ethoxylate[3] | 7.6 | — | — | — | 1.0 | 0.2 | 0.2 |
| $C_{12}$ alkyl dimethyl amine oxide[5] | | | | | | 0.6 | 0.6 |
| 1,2 Propane diol | 6.0 | 1.3 | 1.3 | 6.0 | 0.2 | 0.8 | 0.8 |
| Ethanol | — | 1.3 | 1.3 | — | 1.4 | 0.7 | 0.7 |
| Di Ethylene Glycol | 4.0 | — | — | — | — | | |
| Na Cumene Sulfonate | — | 1.0 | 1.0 | 0.9 | — | 1.1 | 3.1 |
| $C_{12}$-$C_{18}$ Fatty Acid[5] | 9.5 | 3.5 | 3.5 | 3.5 | 4.5 | 0.7 | 0.7 |
| Citric acid | 2.8 | 3.4 | 3.4 | 3.4 | 2.4 | 2.1 | 2.1 |
| Protease (40.6 mg/g/)[7] | 1.0 | 0.6 | 0.6 | 0.6 | 0.3 | | |
| Protease (54.5 mg/g/)[7] | | | | | | 0.3 | 0.3 |
| Natalase 200 L (29.26 mg/g)[14] | — | 0.1 | 0.1 | 0.1 | — | | |
| Termamyl Ultra (25.1 mg/g)[14] | 0.7 | 0.1 | 0.1 | 0.1 | 0.1 | 0.1 | 0.1 |
| Mannaway 25 L (25 mg/g)[14] | 0.1 | 0.1 | 0.1 | 0.1 | 0.02 | | |
| Whitezyme (20 mg/g)[14] | 0.2 | 0.1 | 0.1 | 0.1 | — | | |
| Fluorescent Whitening Agent[8] | 0.2 | 0.1 | 0.1 | 0.1 | — | 0.04 | 0.04 |
| Diethylene Triamine Penta Methylene Phosphonic acid | — | 0.3 | 0.3 | 0.3 | 0.1 | | |
| Diethylenetriamine pentaacetic acid[6] | | | | | | 0.4 | 0.4 |
| Hydroxy Ethylidene 1,1 Di Phosphonic acid | 1.5 | — | — | — | — | | |
| Zwitterionic ethoxylated quaternized sulfated hexamethylene diamine[11] | 2.1 | 1.0 | 1.0 | 1.0 | 0.7 | | |
| Grease Cleaning Alkoxylated Polyalkylenimine Polymer[10] | — | 0.4 | 0.4 | 0.4 | — | | 1.5 |
| Ethoxylated polyamine[9] | | | | | | 2.2 | |
| PEG-PVAc Polymer[15] | 0.9 | 0.5 | 0.5 | 0.5 | — | | |
| Hydrogenated castor oil[12] | 0.8 | 0.4 | 0.4 | 0.4 | 0.3 | 0.15 | 0.15 |
| Borate | — | 1.3 | — | — | 1.2 | 1.1 | 1.1 |
| 4 Formyl Phenyl Boronic Acid | — | — | 0.025 | — | — | | |
| Silicone emulsions of any of the Examples 1-3 | 0.5-4.0 | 0.5-4.0 | 0.5-4.0 | 0.5-4.0 | 0.5-4.0 | 0.5-4.0 | 0.5-4.0 |
| Tinosan ® HP 100 via BASF | | | | | | 0.05 | 0.05 |
| Water, solvents, perfumes, dyes, buffers, neutralizers, stabilizers and other optional components | to 100% pH 8.0-8.2 | to 100% pH 8.0-8.2 | to 100% pH 8.0-8.2 | to 100% pH 8.0-8.2 | to 100% pH 8.0-8.2 | to 100% pH 8.0-8.5 | to 100% pH 8.0-8.5 |

Ingredient Key for Examples 6 and 7:

[1]Available from Shell Chemicals, Houston, TX.

[2]Available from Huntsman Chemicals, Salt Lake City, UT.

[3]Available from Sasol Chemicals, Johannesburg, South Africa

[4]Available from Evonik Corporation, Hopewell, VA.

[5]Available from The Procter & Gamble Company, Cincinnati, OH.

[6]Available from Sigma Aldrich chemicals, Milwaukee, WI

[7]Available from Genencor International, South San Francisco, CA.

[8]Available from Ciba Specialty Chemicals, High Point, NC

[9]600 g/mol molecular weight polyethylenimine core with 20 ethoxylate groups per —NH and available from BASF (Ludwigshafen, Germany)

[10]600 g/mol molecular weight polyethylenimine core with 24 ethoxylate groups per —NH and 16 propoxylate groups per —NH. Available from BASF (Ludwigshafen, Germany).

[11]Described in WO 01/05874 and available from BASF (Ludwigshafen, Germany)

[12]Available under the tradename Thixin ® R from Elementis Specialties, Highstown, NJ

[13]Available from Nalco Chemicals, Naperville, IL.

[14]Available from Novozymes, Copenhagen, Denmark.

[15]PEG-PVA graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units. Available from BASF (Ludwigshafen, Germany).

Example 8

Rinse-Added Fabric Care Compositions. Rinse-added fabric care compositions 8A-8D are prepared by mixing together ingredients shown below:

| Ingredient | 8A | 8B | 8C | 8D |
|---|---|---|---|---|
| Fabric Softener Active[1] | 16.2 | 11.0 | 16.2 | — |
| Fabric Softener Active[2] | — | — | — | 5.0 |
| Cationic Starch[3] | 1.5 | — | 1.5 | — |
| Polyethylene imine[4] | 0.25 | 0.25 | — | — |
| Quaternized polyacrylamide[5] | — | | 0.25 | 0.25 |
| Calcium chloride | 0.15 | 0. | 0.15 | — |
| Ammonium chloride | 0.1 | 0.1 | 0.1 | — |
| Silicone emulsions of any of the Examples 1-3 | 0.5-8.0 | 0.5-8.0 | 0.5-8.0 | 0.5-8.0 |
| Perfume | 0.85 | 2.0 | 0.85 | 1.0 |
| Perfume microcapsule[6] | 0.65 | 0.75 | 0.65 | 0.3 |
| Water, suds suppressor, stabilizers, pH control agents, buffers, dyes & other optional ingredients | to 100% pH = 3.0 | to 100% pH = 3.0 | to 100% pH = 3.0 | to 100% pH = 3.0 |

[1]N,N di(tallowoyloxyethyl) - N,N dimethylammonium chloride available from Evonik Corporation, Hopewell, VA.
[2]Reaction product of fatty acid with Methyldiethanolamine, quaternized with Methylchloride, resulting in a 2.5:1 molar mixture of N,N-di(tallowoyloxyethyl) N,N-dimethylammonium chloride and N-(tallowoyloxyethyl) N-hydroxyethyl N,N-dimethylammonium chloride available from Evonik Corporation, Hopewell, VA.
[3]Cationic starch based on common maize starch or potato starch, containing 25% to 95% amylose and a degree of substitution of from 0.02 to 0.09, and having a viscosity measured as Water Fluidity having a value from 50 to 84. Available from National Starch, Bridgewater, NJ
[4]Available from Nippon Shokubai Company, Tokyo, Japan under the trade name Epomin ® 1050.
[5]Cationic polyacrylamide polymer such as a copolymer of acrylamide/[2-(acryloylamino)ethyl]tri-methylammonium chloride (quaternized dimethyl aminoethyl acrylate) available from BASF, AG, Ludwigshafen under the trade name Sedipur ® 544.
[6]Available from Appleton Paper of Appleton, WI The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An amino silicone nanoemulsion comprising:

a. one or more liquid amino silicone compounds represented by formula (1) below:

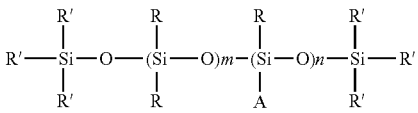

(1)

where each R is an alkyl group or a phenyl group with 1-10 carbon atoms, wherein each R' is an alkyl group having 1-10 carbon atoms, a phenyl group, a monovalent group represented by formula (2) below, or a monovalent group represented by the formula: —$OR^3$, where $R^3$ is a hydrogen atom or a monovalent hydrocarbon group with 1-10 carbon atoms;

m is a whole number from 50-1000, n is a whole number from 1-100,

A is a monovalent group represented by formula (2) below:

$$—R^1—(NH—R^2)a\text{-}NH_2 \quad (2)$$

where $R^1$ and $R^2$ are divalent hydrocarbon groups with 1-10 carbon atoms;

a is a whole number from 0-4;

b. an internal phase diluent comprising a C3-C6 alkylene glycol alkyl ether;

c. a surfactant system; and d. a protonating agent.

2. An amino silicone nanoemulsion according to claim 1, wherein the average particle size of the nanoemulsion is from about 20 nm to about 500 nm.

3. An amino silicone nanoemulsion according to claim 1, wherein the average particle size of the nanoemulsion is from about 50 nm to about 150 nm.

4. An amino silicone nanoemulsion according to claim 1, wherein the C3-C6 alkylene glycol alkyl ether is selected from the group consisting of a monopropylene glycol alkyl ether, a dipropylene glycol alkyl ether, a tripropylene glycol alkyl ether, and mixtures thereof.

5. An amino silicone nanoemulsion according to claim 4, wherein the C3-C6 alkylene glycol alkyl ether is selected from the group consisting of a monopropylene glycol n-butyl ether, a dipropylene glycol n-butyl ether, a tripropylene glycol n-butyl ether, and mixtures thereof.

6. An amino silicone nanoemulsion according to claim 5, wherein the C3-C6 alkylene glycol alkyl ether is a monopropylene glycol n-butyl ether.

7. An amino silicone nanoemulsion according to claim 1, wherein the C3-C6 alkylene glycol alkyl ether comprises C3-C6 alkylene glycol C1-C12 alkyl ether.

8. An amino silicone nanoemulsion according to claim 7, wherein the C3-C6 alkylene glycol alkyl ether comprises C3-C6 alkylene glycol C1-C4 alkyl ether.

9. An amino silicone nanoemulsion according to claim 1, wherein the surfactant system comprises a surfactant selected from nonionic surfactant, anionic surfactant, cationic surfactant, zwitterionic surfactant, ampholytic surfactant, amphoteric surfactant, and mixtures thereof.

10. An amino silicone nanoemulsion according to claim 9, wherein the surfactant system comprises nonionic surfactant, cationic surfactant, or mixtures thereof.

11. An amino silicone nanoemulsion according to claim 10, wherein the surfactant system consists of nonionic surfactant.

12. An amino silicone nanoemulsion according to claim 11, wherein the nonionic surfactant comprises at least a first nonionic surfactant and a second nonionic surfactant.

13. An amino silicone nanoemulsion according to claim 12, wherein the first nonionic surfactant is characterized by a first HLB value, wherein the second nonionic surfactant is characterized by a second HLB value, and wherein the amino silicone is characterized by a third HLB value that is between the first HLB value and the second HLB value.

14. An amino silicone nanoemulsion according to claim 13, wherein the nonionic surfactant is an alkoxylated alcohol.

15. An amino silicone nanoemulsion according to claim 1, wherein the protonating agent is selected from the group consisting of formic acid, acetic acid, propionic acid, malonic acid, citric acid, hydrochloric acid, sulfuric acid, phosphoric acid, nitric acid, and mixtures thereof.

16. An amino silicone nanoemulsion according to claim 15, wherein the protonating agent is acetic acid.

17. An amino silicone nanoemulsion according to claim 1, wherein the nanoemulsion comprises from about 15% to about 60%, by weight of the nanoemulsion, of the amino silicone.

18. An amino silicone nanoemulsion according to claim 1, wherein the nanoemulsion comprises from about 10% to about 50%, by weight of the amino silicone, of the internal phase diluent.

19. An amino silicone nanoemulsion according to claim 1, wherein the amino silicone nanoemulsion is substantially free of a silicone resin.

20. An amino silicone nanoemulsion according to claim 1, wherein the amino silicone nanoemulsion is characterized by a Percentage Transmittance (% T) of at least about 80% at 480 nm.

21. A method of making an amino silicone nanoemulsion according to claim 1, comprising the steps of:

mixing the amino silicone with the internal phase diluent to form a first composition;

adding the surfactant system, the protonating agent, and water to the first composition; and mixing.

22. A method of making an amino silicone nanoemulsion according to claim 21, wherein the mixing uses an energy density of less than about 4 $kW/m^3$.

23. A treatment composition comprising the nanoemulsion of claim 1.

24. A method of making a treatment composition comprising the nanoemulsion of claim 1, comprising the steps of:

providing a base composition;

mixing in the amino silicone nanoemulsion of claim 1.

* * * * *